US005133299A

United States Patent [19]

Rogan

[11] Patent Number: 5,133,299

[45] Date of Patent: Jul. 28, 1992

[54] TUBESHEET COVER PLATE

[75] Inventor: Francis Rogan, Portland, Oreg.

[73] Assignee: Aptech Engineering Services, Inc., Sunnyvale, Calif.

[21] Appl. No.: 728,772

[22] Filed: Jul. 8, 1991

Related U.S. Application Data

[63] Continuation of Ser. No. 414,709, Sep. 19, 1989, abandoned.

[51] Int. Cl.[5] ..... F22B 37/06

[52] U.S. Cl. ..... 122/511; 122/512; 122/406.3; 165/134.1

[58] Field of Search ..... 122/511, 512, DIG. 13, 122/360, 406; 165/134.1, 158

[56] References Cited

U.S. PATENT DOCUMENTS

| | | | |
|---|---|---|---|
| 513,620 | 1/1894 | Phillips | 122/512 |
| 1,042,044 | 10/1912 | Shierk | 122/512 X |
| 1,917,533 | 7/1933 | Lucke | 122/511 X |
| 1,948,540 | 2/1934 | Noack | 122/511 |
| 2,682,861 | 7/1954 | Durham et al. | 122/512 |
| 2,862,694 | 12/1958 | Lortz | 122/511 X |
| 4,182,408 | 1/1980 | Laber | 165/134.1 X |
| 4,336,770 | 6/1982 | Kaneko et al. | 122/DIG. 13 X |
| 4,473,112 | 9/1984 | Noe et al. | 165/158 |
| 4,607,689 | 8/1986 | Mochida et al. | 122/406 B X |

FOREIGN PATENT DOCUMENTS

| | | | |
|---|---|---|---|
| 964218 | 8/1950 | France | 122/512 |

*Primary Examiner*—Henry C. Yuen
*Attorney, Agent, or Firm*—Limbach & Limbach

[57] ABSTRACT

A tubesheet cover plate and method is described wherein a plate is provided for covering the tubesheet face and with apertures with outwardly flared openings into each tube.

2 Claims, 1 Drawing Sheet

TUBESHEET COVER PLATE

This application is a continuation of co-pending applications Ser. No. 414,709 filed on Sept. 19, 1989, now abandoned.

The present invention relates in general to large capacity steam generators and more particularly to improvements for protecting the steam generator tubesheet and enhancing the efficiency and reliability of steam generators.

Large power plants include steam generators which have heat exchanger tubesheets made up of a multiplicity of tubes, the end of which project through a tubesheet to which the tubes are sealably secured such as by a weld. As the steam generators age a number of the tubes deteriorate and certain tubes of a tubesheet may be closed off thereby reducing the overall efficiency of the steam generator. Additionally, the entrance ends of the tubes of the tubesheets and the welds between the tubes and the tubesheet faceplate are susceptible to damage from loose parts such as nuts and bolts. These find their way into steam generators where the flow stream causes the articles repeatedly to strike the tubesheet tube ends thereby damaging them severely and reducing the flow through the tubes and to strike the faceplate damaging the seal between the tube and the faceplate and threatening the integrity of the tubesheet.

SUMMARY OF THE INVENTION

The present invention is directed to the provision of a method and cover plate which covers the tubesheet faceplate, the tube ends and the joint between the tubes and faceplate of the tubesheet, and wherein the cover plate includes designed apertures for each tube with the basic aperture equal to the inside diameter of the tube but flared outwardly toward the face of the cover plate remote from the tube thereby resulting in increased flow efficiency of the steam generator while at the same time protecting against potential destructive collisions between loose articles and the tubes, the faceplate and the seal between the tubes and faceplate of the tubesheet.

These and other features and advantages of the present invention will become more apparent upon a perusal of the following specification taken in conjunction with accompanying drawings wherein similar characters of reference identify similar structure in each of the several views. In the drawings.

Figure 1:
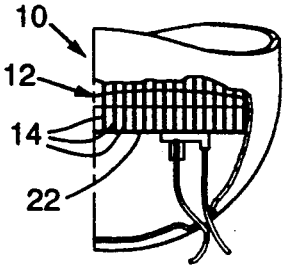
FIG. 1 is an elevational view, partially broken away showing a cover plate on the input of a steam generator tubesheet.
Figure 2B:
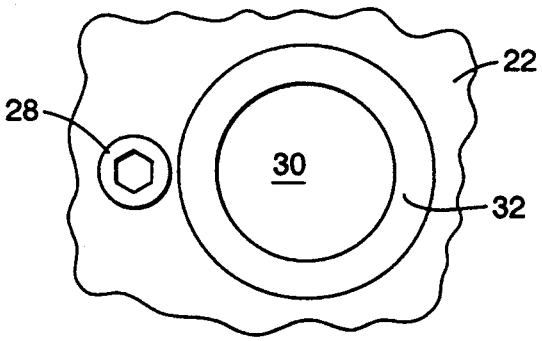
FIG. 2B is a plan view of a portion of the structure of FIG. 2A taken along line B—B.
Figure 2A:
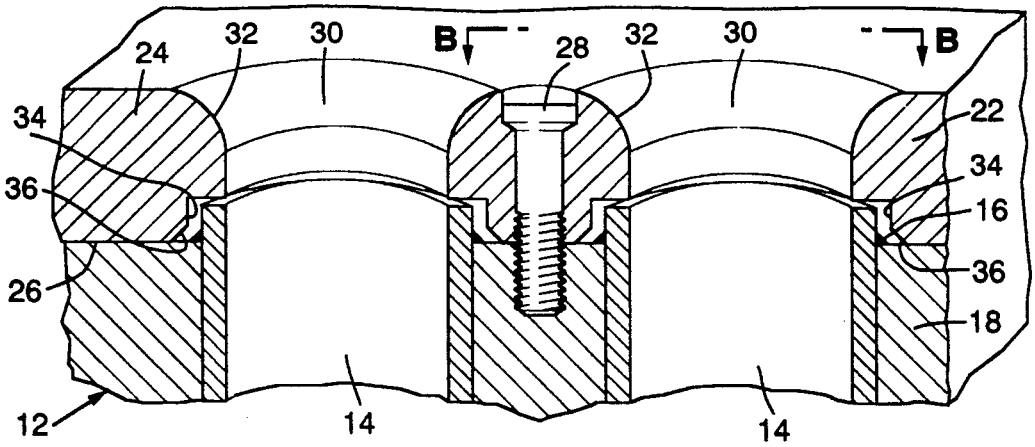
FIG. 2A is an enlarged perspective view partially in section of a portion of the structure shown in FIG. 1.

Referring now to FIGS. 1 and 2 there is shown an elevational view of the lower end of a steam generator 10 having a tubesheet 12 made up of a multiplicity of tubes 14 each of which projects through and is sealably and fixedly secured, such as by a weld 16, to a tubesheet faceplate 18.

A tubesheet cover plate 22 is provided over the face of the faceplate 18 through which the tubes 14 project. The cover 22 has an exposed surface 24 and a surface 26 contiguous with the faceplate 18 and is secured to the faceplate such as by bolts 28 or welds. The cover 22 is provided with an aperture 30 for each of the tubesheet tubes 14. Each aperture 30 is centered over one of the tubes 14, and at the exposed surface 24 of the cover 22 each aperture 30 has a smoothly outwardly flared entrance 32.

Each of the apertures is provided with an enlarged diameter 34 at the cover plate surface 26 contiguous to the faceplate 18 for receiving the protruding ends of the tubes 16 as well as an outwardly beveled edge 36 to the enlarged diameter portions 34 to receive the weld 16 between the tubes 14 and the tubesheet faceplate 18.

The cover plate 22 is typically made up of a number of different sections, each small enough to be inserted through the manway opening in the base of an existing steam generator 10 and then affixed to the tubesheet faceplate 18. Typically, the tubes 14 of the tubesheet are a standard size located in a rectilinear pattern on a standard pitch so that the apertures 30 can be machined in the cover plate 22 beginning from one of the two surfaces 24 or 26 to provide the aperture and either the outwardly flared entrance 32 or the enlarged diameter 34 and beveled edge 36 in single operation and the cover plate turned over and the treatment of the entrance to the aperture on the other surface of the cover plate performed in a separate operation. In one typical embodiment a tubesheet exists with $\frac{7}{8}''$ outside diameter tubes in a square pitch pattern of 1.28".

Figure 3:
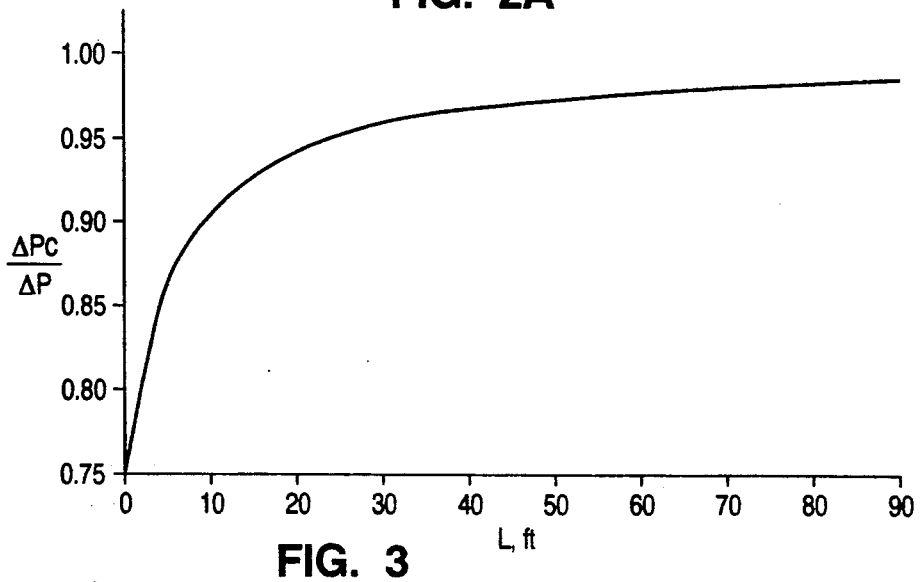
FIG. 3 is a graph plotting the ratio of $\Delta P_c/\Delta P$ versus length. While the present invention has equal applications to many heat exchanger devices, it is principally designed and advantageous for application to a steam generator.

FIG. 3 illustrates a graph showing the efficiency improvement utilizing the present invention. FIG. 3 is a plot of $\Delta P_c/\Delta P$ plotted against the length of the tubesheet tubes in feet wherein $\Delta P$ is the change of pressure through the tubesheet without a cover plate in accordance with this invention and $\Delta P_c$ is the change in pressure across the tubes of the tubesheet which have been provided with the cover plate and the outwardly curved flared entrance 32 into the tubes. The graph illustrates that the enhanced operation of the tubesheet with the cover plate 22 goes from an efficiency increase between 75 and 80 percent for a very short tubesheet down to about 2 percent for a tubesheet 100 feet long.

Obviously certain modifications can be made to the construction of the cover plate still in keeping with the present invention. For example, there will be situations where an aperture will not be required for every single tube in the tubesheet because some tubes may have been closed off. It is common practice in the industry when potential problems are detected with respect to individual tubes of the tubesheet completely to close off flow through that tube. Closing off individual tubes will decrease the efficiency of a steam generator which then can be overcome to a degree by the provision of the present invention. The cover plate may also be utilized to support and enhance other attachments such as tube sleeves and inspection devices commonly used in the heat exchanger.

One form of outwardly flared entrance curve 32 is shown in the drawing. Obviously, slight modifications in the curvature of that flared entrance will still produce enhanced results in accordance with the present invention.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

I claim:

1. In a steam generator having a tubesheet including a faceplate having a multiplicity of tubes sealably connected thereto and passing and projecting therethrough a short distance the improvement comprising a cover plate means made up of a number of sections each fitting through the manway of the steam generator for fitting and attaching onto and covering the tubesheet faceplate and for shielding the faceplate and the joint between the tubes and faceplate from collision with loose articles, said cover plate having a first surface to be contiguous with said faceplate, having a second surface spaced from said first surface and having a multitude of apertures therethrough between said first and said second surfaces, substantially every aperture corresponding to one of the tubes of the tubesheet and having a minimum diameter corresponding to the inside diameter of the tubes, each aperture having a substantially smoothly outwardly flared entrance remote from said first surface, the surface of each aperture carrying the entrances of the corresponding tube out to said second surface.

2. In the steam generator of claim 1 said cover plate having an annular enlargement of each aperture at said first surface for receiving the short length of the tube projecting through the tubesheet faceplate.

* * * * *